United States Patent [19]

Schultz

[11] Patent Number: 4,957,167

[45] Date of Patent: Sep. 18, 1990

[54] RETRIEVABLE FLUID CONTROL VALVE WITH DAMPING

[75] Inventor: Roger L. Schultz, Plano, Tex.

[73] Assignee: Halliburton Co., Stephens County, Okla.

[21] Appl. No.: 338,256

[22] Filed: Apr. 14, 1989

[51] Int. Cl.[5] ..... E21B 34/08

[52] U.S. Cl. ..... 166/319; 166/324; 251/117

[58] Field of Search ..... 166/319, 320, 321, 322, 166/323, 324, 332, 151; 251/117, 118; 137/DIG. 5

[56] References Cited

U.S. PATENT DOCUMENTS

| | | | |
|---|---|---|---|
| 2,740,479 | 4/1956 | Schwegman | 166/145 |
| 2,854,929 | 10/1958 | McGowen, Jr. et al. | 103/221 |
| 2,888,080 | 5/1959 | Tausch et al. | 166/192 |
| 3,503,601 | 3/1970 | Wells | 267/1 |
| 3,754,568 | 8/1973 | Gallagher et al. | 137/516.29 |
| 3,847,223 | 11/1974 | Scott et al. | 166/305 R |
| 3,877,344 | 4/1975 | Langland | 251/117 |
| 3,906,839 | 9/1975 | Schexnayder | 137/491 |
| 4,133,516 | 1/1979 | Jurgens | 267/125 |
| 4,274,490 | 6/1981 | Huckaby | 166/325 |
| 4,399,871 | 8/1983 | Adkins et al. | 166/325 |
| 4,461,316 | 7/1984 | Cove et al. | 251/118 |
| 4,586,569 | 5/1986 | Hyde | 166/317 |
| 4,629,002 | 12/1986 | Pringle | 166/324 |

*Primary Examiner*—Stephen J. Novosad
*Assistant Examiner*—Terry Lee Melius

[57] ABSTRACT

A retrievable fluid control valve apparatus is provided for controlling fluid flow into a tubing string of a well. The control valve apparatus includes a housing. The housing includes a seal for sealingly engaging a landing nipple of the tubing string. A flow passage is defined through the housing and has an open end defined in the housing below the seal. A flow port is defined through the housing and communicates the flow passage with an exterior of the housing above the seal. A flow valve is disposed in the housing and is movable between a closed position wherein the flow passage is closed and an open position wherein the flow passage is open. A spring is associated with the flow valve for biasing the flow valve toward its closed position. A differential area piston is associated with the flow valve for overcoming the force of the spring and moving the flow valve to its open position when a fluid pressure in the tubing string exterior of the housing exceeds a predetermined value. A dampening sub is included in the control valve apparatus for damping closing movement of the valve from its open position to its closed position. The damping sub extremely overdamps the system thus eliminating hydrodynamically induced flutter of the spring biased valve, and also providing for a soft closing motion of the valve.

15 Claims, 6 Drawing Sheets

RETRIEVABLE FLUID CONTROL VALVE WITH DAMPING

BACKGROUND OF THE INVENTION

1. Field Of The Invention

This invention relates generally to retrievable fluid control valves for controlling fluid flow through a tubing string of a well.

2. Description Of The Prior Art

In the petroleum industry, there is often a need to pump fluids down a tubing string into a subsurface formation of a well. Such fluids are used for a variety of purposes including fracturing, scale removal, chemical treatments, acidizing, and the like.

In many situations, when performing such treating operations on a well it is desirable to control the amount of fluid pumped into the formation. For example, when using expensive chemicals for treatment, it may be desired to minimize the volume of the chemical lost in the well. This is accomplished with valves known as retrievable fluid control valves which are used with a seating nipple at or near the lowest joint of tubing in the well. This type of valve is also useful in protecting weak formations from treating fluids under hydrostatic pressure. These valves can be preset to open and close at specific tubing pressures to allow controlled pumping of fluid into the formation.

U.S. Pat. No. 3,847,223 to Scott et al., and assigned to the assignee of the present invention, discloses such a retrievable fluid control valve having a spring biased valve member which opens in response to a differential pressure created across an annular piston associated with the valve member.

Further developments in such retrievable fluid control valves are shown in U.S. Pat. No. 4,586,569 to Hyde, also assigned to the assignee of the present invention. The Hyde patent discloses a retrievable fluid control valve having a plurality of individually adjustable springs which are connected in mechanical parallel thus providing an adjustable biasing spring for the valve.

Operating experience with retrievable fluid control valves such as those shown in the Hyde '569 patent have shown that there are sometimes problems associated with the valve and seat. The most frequently encountered problem is breakage of the valve or the valve seat. The present invention is directed to an improvement for retrievable fluid control valves generally like those shown in the Hyde '569 patent which will minimize, if not completely eliminate, these previously encountered problems of valve and valve seat breakage.

SUMMARY OF THE INVENTION

A retrievable fluid control valve apparatus includes a housing having sealing means defined thereon for sealingly engaging a landing seat of a tubing string. A flow passage is defined through the housing and has an open end defined in the housing below the sealing means. A flow port is defined through the housing and communicates the flow passage with an exterior of the housing above the sealing means.

A flow valve means is disposed in the housing and is movable between a closed position wherein the flow passage is closed, and an open position wherein the flow passage is open.

Spring biasing means is associated with the flow valve means for biasing the flow valve means toward its closed position. A differential area piston is associated with the flow valve means for overcoming the spring biasing means and moving the flow valve means to its said open position when a fluid pressure exterior of the housing at the flow port exceeds a predetermined value.

A damping means is associated with the flow valve means for damping closing movement of the flow valve means from its open position to its closed position. The damping means is provided in the form of a damping sub which can be retrofit to a retrievable fluid control valve apparatus like that shown in Hyde U.S. Pat. No. 4,586,569.

The damping sub includes a piston means slidably received in a damping chamber and constructed to move with a movable valve member of the valve means. The piston means has a fluid restrictor placed in a passage therethrough for restricting flow of hydraulic fluid therethrough and thus damping closing movement of the valve member. A bypass disposed in the piston means allows substantially unrestricted opening movement of the valve member.

The hydraulic dampening provided by the fluid restrictor in the piston means is designed such that the entire system is extremely overdamped thus eliminating any possibility of hydrodynamic fluttering or rapid closure of the valve member on its seat.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1A:
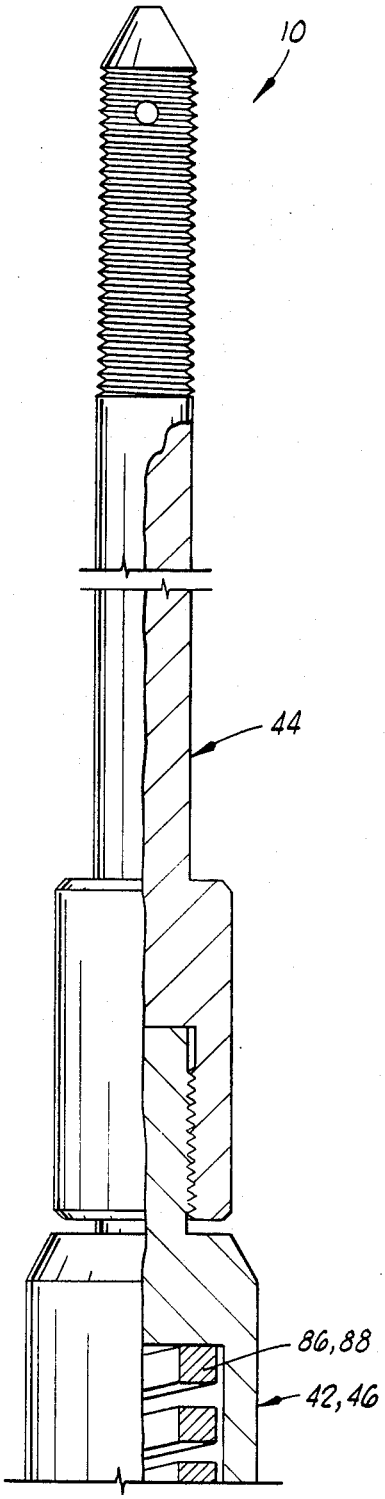
FIGS. 1A–1G comprise an elevation, partly sectioned view of the retrievable fluid control valve apparatus of the present invention.
Figure 1B:
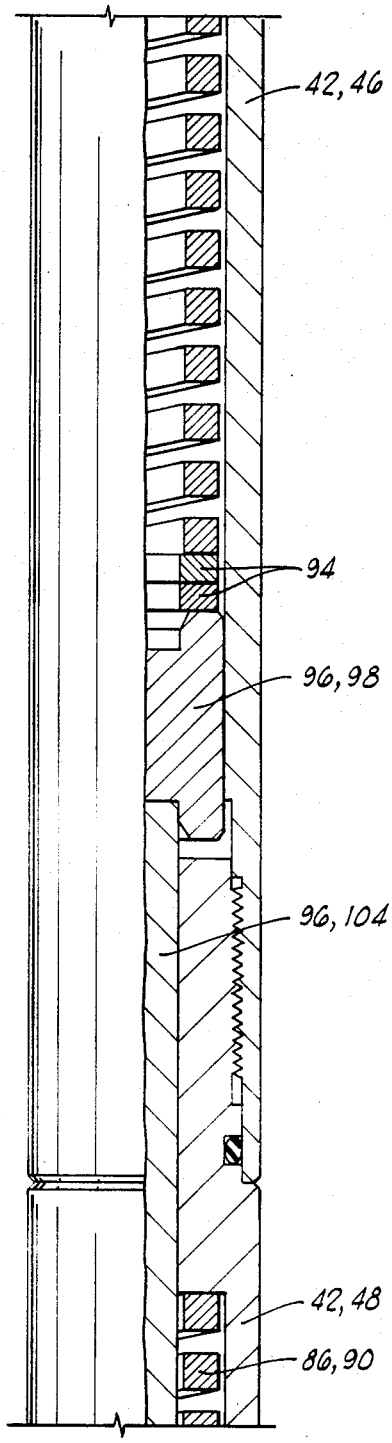
Figure 1C:
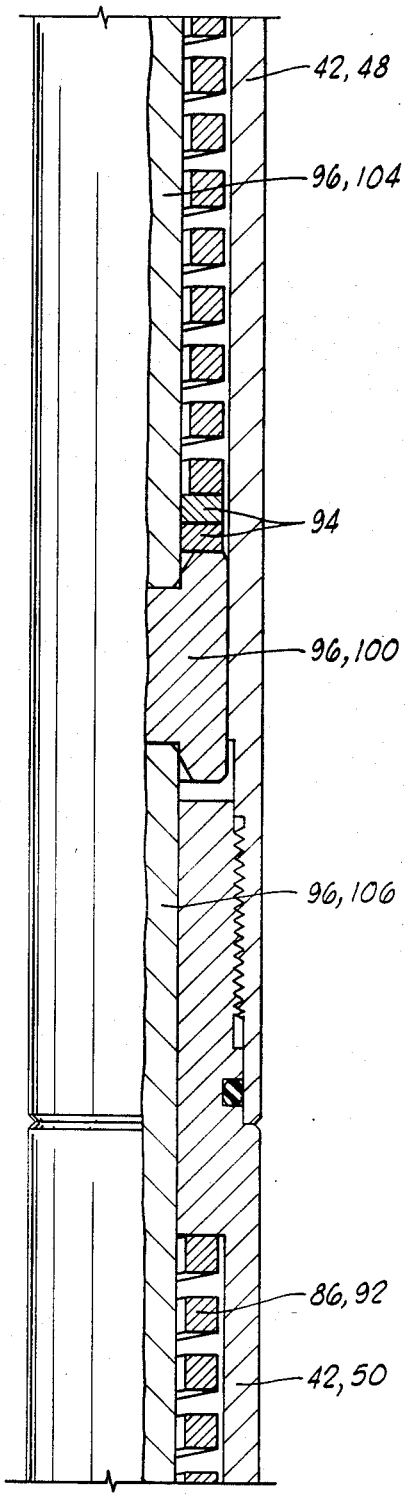
Figure 1D:
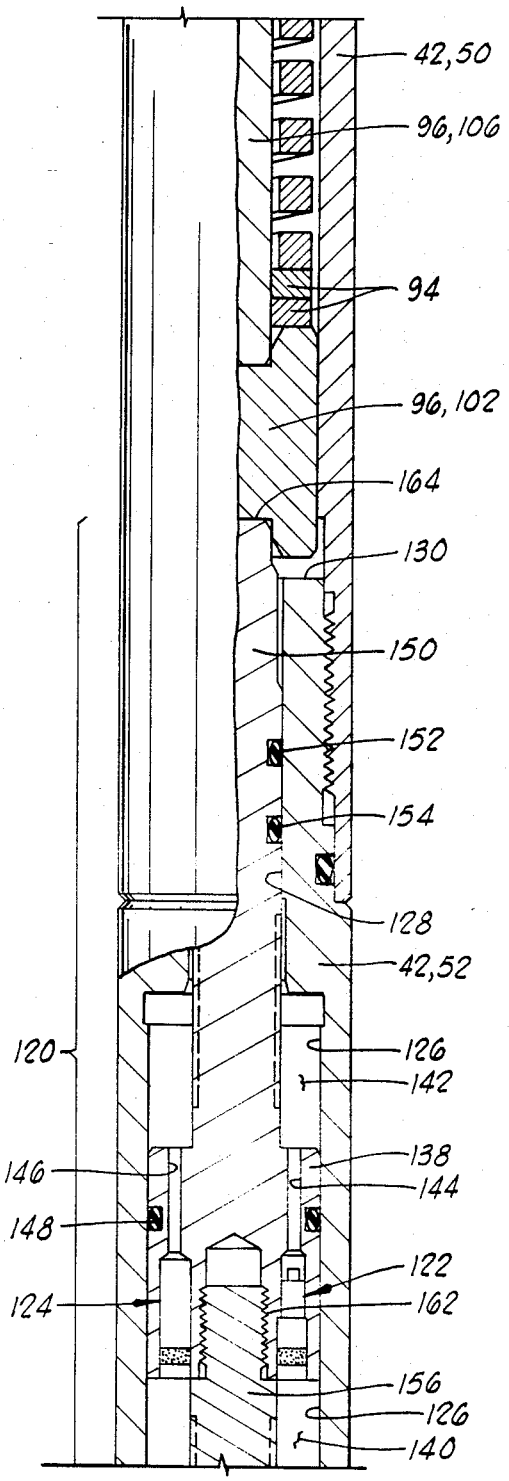
Figure 1E:
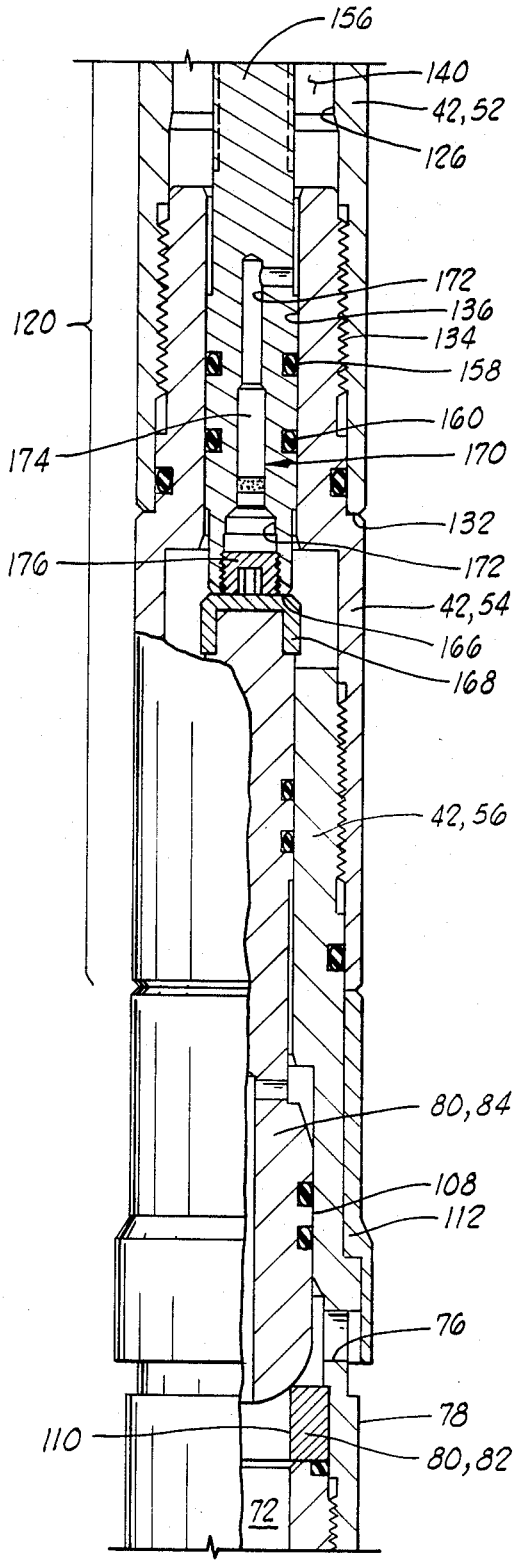

Referring now to the drawings, a retrievable fluid control valve apparatus is shown in elevation cross-sectioned view in FIGS. 1A–1G and is generally designated by the numeral 10. The valve 10 is shown in FIG. 2 in place within a well generally designated by the numeral 12.

The well 12, which is only schematically shown, includes a well casing 14 set in concrete 16 within a bore hole 18. The well intersects a subsurface formation 20 from which oil or gas is to be produced.

A tubing string 22 extends down into the casing 14. Near a lower end of the tubing string a packer 24 seals an annulus 26 between the tubing string 22 and casing 14. Within the casing 14, below the tubing string 22, a bridge plug 28 blocks the entire cross section of the well casing 14.

The retrievable fluid control valve apparatus 10 is landed in a landing nipple 30 located in the lower portion of tubing string 22.

FIG. 2 illustrates the use of the retrievable fluid control valve apparatus 10 in a well fracturing operation. As previously mentioned, the valve apparatus 10 may be utilized in any number of other types of well treatments, and the fracturing operation illustrated in FIG. 2 is only intended to provide an example of the manner in which the valve apparatus 10 may be used.

A plurality of perforations 32 have been formed through the well casing 14 and cement 16 so as to communicate the interior of well casing 14 with the subsurface formation 20.

High pressure fracturing fluid from a source 34 is pumped by high pressure pump 36 into the tubing string 22. As is further described below, the retrievable fluid control valve apparatus 10 will allow this fracturing fluid to flow therethrough when the pressure at the valve apparatus 10 exceeds a predetermined level. Then, the fracturing fluid will flow through the valve apparatus 10 and out the lower end 38 of tubing string 22 then through the perforations 32 into the formation 20 to form fractures 40 therein.

Turning now to FIGS. 1A–1G, the details of construction of the retrievable fluid control valve apparatus 10 are thereshown. The valve apparatus 10 includes a housing generally designated by the numeral 42. A fishing member 44 is connected to the upper end of housing 42 for use in retrieving the valve apparatus 10.

The housing means 42 includes, from top to bottom, first, second and third spring housing sections 46, 48 and 50, a damping chamber housing section 52, a chamber end cap housing section 54, a flow valve housing section 56, a first adapter housing section 58, a bypass mandrel 60, a bypass housing section 62, a second adapter housing section 64, a seal housing section 66, and a lower nose member 68.

The housing 42 includes an annular sealing means 70 carried about seal housing section 66, for sealingly engaging the landing nipple 30 of tubing string 22.

A flow passage 72 is defined through housing 42 and has an open lower end 74 defined in the housing 42 below the sealing means 70.

The housing 42 includes a plurality of flow ports 76 (see FIG. 1E) defined therethrough and communicating the flow passage 72 with an exterior 78 of housing 42 above the sealing means 70.

A flow valve means 80 is disposed in the housing 42 and includes an annular seat 82 and a sliding valve member 84. The flow valve means 80 is shown in FIG. 1E in its closed position wherein the valve member 84 sealingly engages the valve seat 82 so that the flow passage 72 is closed. The valve member 84 may move upward within the housing 42 away from the valve seat 80 to an open position wherein the flow passage 72 is open, as is further described below.

A spring biasing means 86 is disposed in housing 42 and associated with the valve means 80 for biasing the sliding valve member 84 of valve means 80 toward its said closed position. The spring biasing means 86 includes first, second and third coil compression springs 88, 90 and 92 received in first, second and third spring housing sections 46, 48 and 50, respectively. Each of the springs 88, 90 and 92 may have associated therewith one or more spacer rings 94 for adjusting the spring rate of each coil spring. The spring means 86 further includes a push rod assembly 96 made up of guide members 98, 100 and 102 and push rods 104 and 106. By means of the push rod assembly 96, the first, second and third springs 88, 90 and 92 are hooked in mechanical parallel so as to bias the sliding valve member 84 downward toward its closed position against the valve seat 82.

Although the spring biasing means 86 illustrated is a mechanical coil compression spring, it will be appreciated that any other suitable type of spring may be used. For example, a gas charged spring means operating on the compressibility of a pressurized gas may be used.

When the sliding valve member 84 is in its closed position as seen in FIG. 1E, fluid pressure within the tubing string 22 adjacent the valve apparatus 10 is communicated through the flow ports 76 and acts against an annular differential area defined between an outside diameter 108 of sliding valve member 84 and an inside diameter 110 of valve seat 82 which coincides with the annular sealing contact of sliding valve member 84 with seat 82.

The annular area defined between outside diameter 108 of sliding valve member 84 and inside diameter 110 of valve seat 82 can be referred to as a differential area piston means associated with the valve member 84 for overcoming the spring biasing means 86 and moving the valve member 84 of valve means 80 to its said open position when a fluid pressure exterior of the housing 42 at the flow port 76 exceeds a predetermined value. This predetermined value is determined by the construction and adjustment of the spring biasing means 86.

An annular screen skirt 112 is disposed about flow valve housing section 56 and partially shields the flow ports 76 to prevent large particles of solid material from entering the flow ports 76.

Figure 1F:
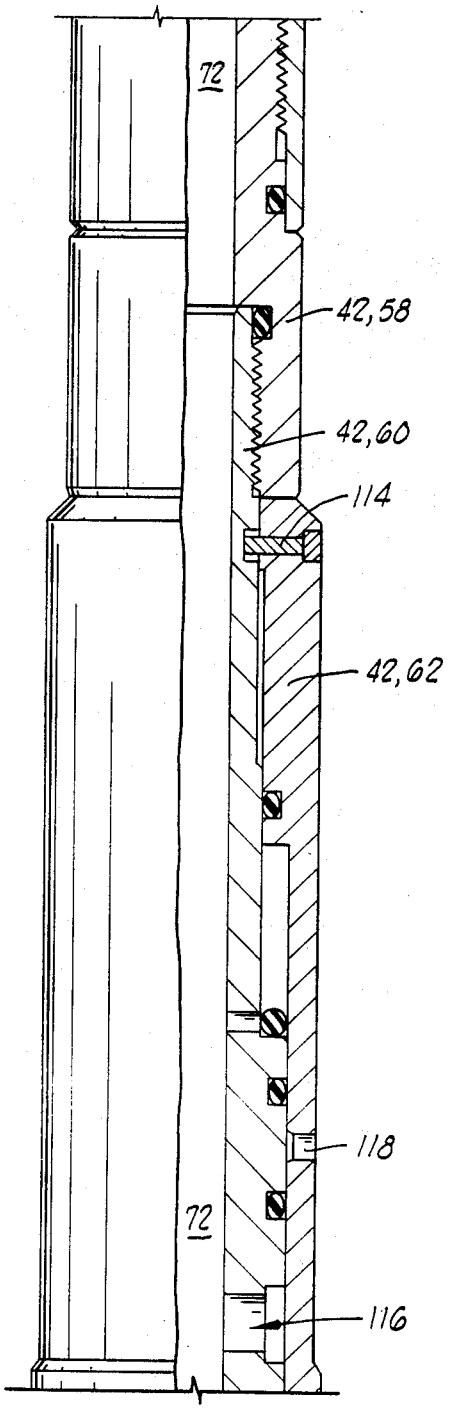
Figure 1G:
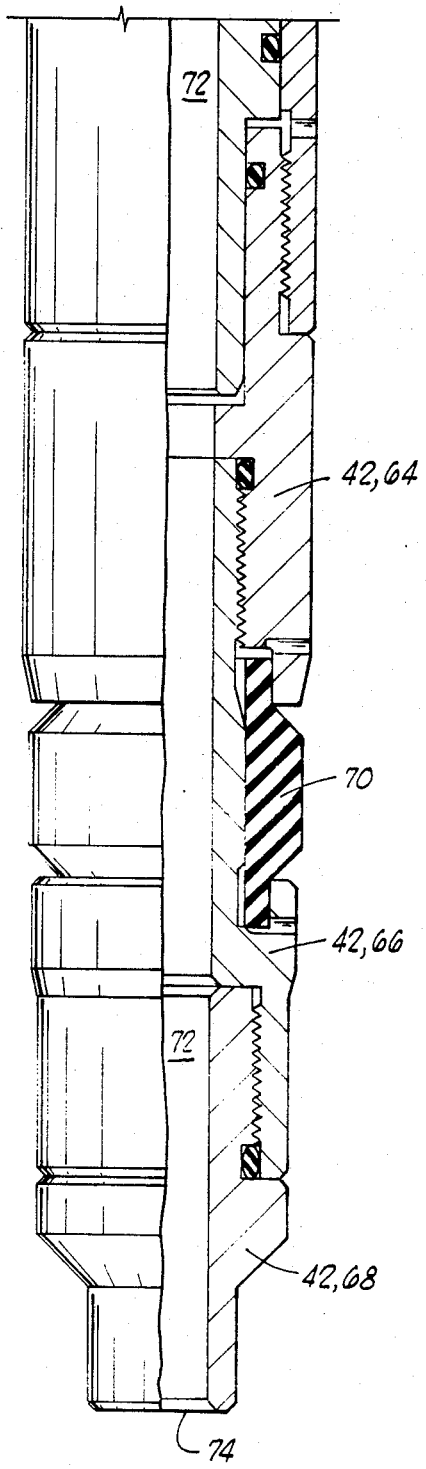
Figure 2:
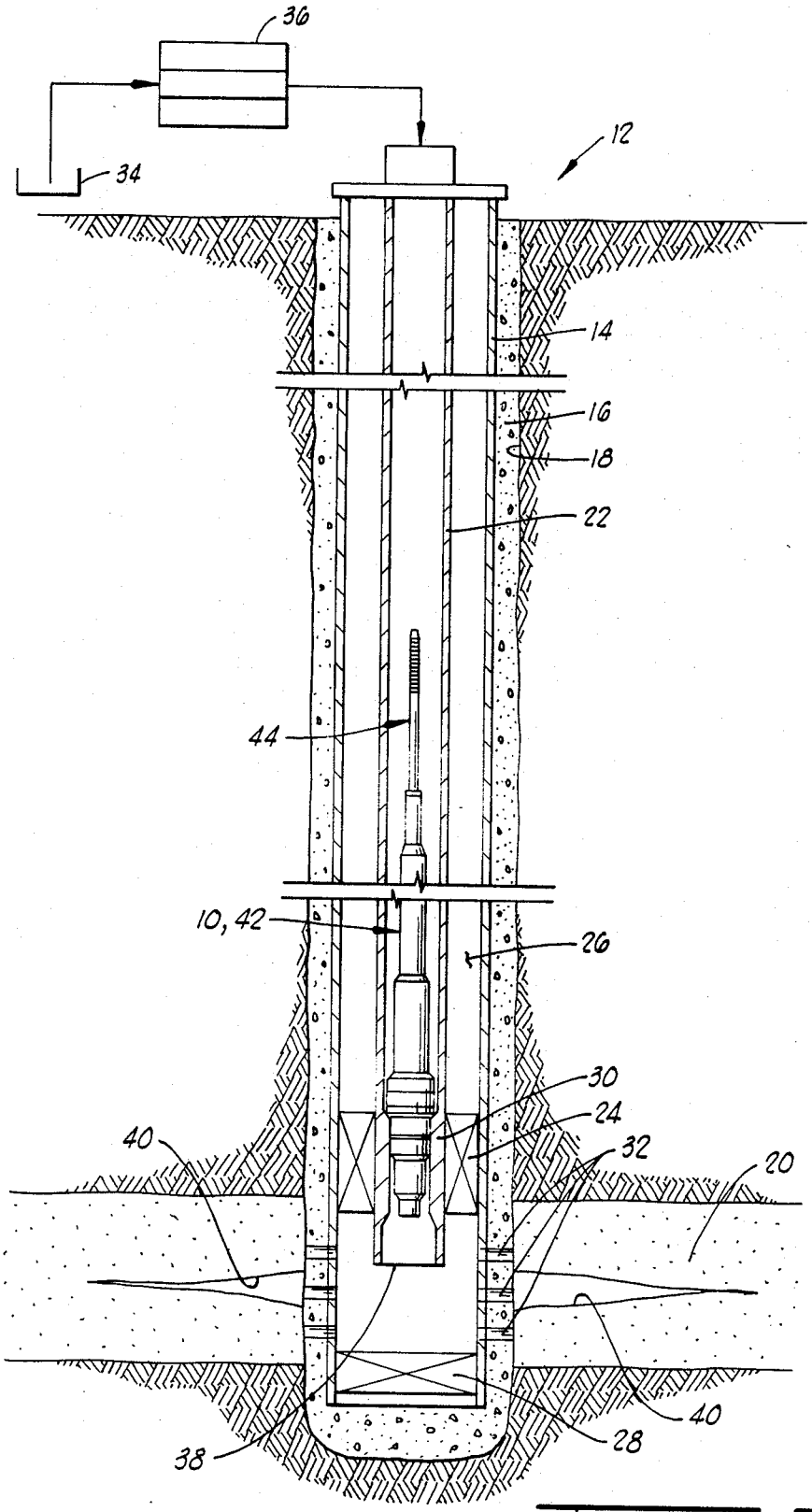
FIG. 2 is a schematic elevation sectioned view showing the retrievable fluid control valve apparatus of FIG. 1 in place within a tubing string in a well.

The bypass mandrel 60 and bypass housing section 62 seen in FIGS. 1F and 1G are initially axially retained together by frangible shear pins 114. When it is desired to retrieve the valve apparatus 10 out of the tubing string 22, an upward pull on fishing member 44 by means of a wire line causes the shear pins 114 to shear and allows the bypass mandrel 60 to move upward relative to bypass housing section 62 until a pair of bypass ports 116 and 118 defined in bypass mandrel 60 and bypass housing section 62, respectively, are aligned to allow fluid pressure within flow passage 72 to equalize on both sides of the sealing means 70 thus allowing the valve apparatus 10 to be easily pulled out of engagement with the landing nipple 32.

Those portions of the valve apparatus 10 just described, except for the damping chamber housing section 52 and chamber end cap housing section 54, along with yet to be described components contained therein, are substantially similar to and function in substantially the same manner as the analogous components disclosed and described in U.S. Pat. No. 4,586,569 to Hyde, the details of which are incorporated herein by reference.

The present invention is related primarily to the construction of a damping sub 120 designed to be utilized with the retrievable fluid control valve apparatus shown in U.S. Pat. No. 4,586,569 to Hyde.

The damping sub 120 includes the damping chamber housing section 52 and chamber end cap section 54 previously mentioned. Sub 120 includes a damping means, generally designated by the numeral 122, associated with the valve means 80, for damping closing movement of the sliding valve member 84 from its open position to its closed position.

As previously mentioned, the spring biasing means 86 can be adjusted. As is described in detail in U.S. Pat. No. 4,586,469 to Hyde, any combination of one or more of the springs 88, 90 and 92 can be utilized along with various combinations of spacer rings 94 to provide a wide range of spring rates within an overall spring rate range.

The damping means 122 can be generally described as a means for substantially, and in fact extremely, overdamping the said closing movement of the sliding valve member 80 of valve means 84 for any and all spring rates within the spring rate range of spring biasing means 86.

The damping sub 120 further includes a bypass means generally designated by the numeral 124 for permitting undamped opening movement of the sliding valve member 84 from its said closed position to its said open position. Thus the damping means 122 can be further characterized as a means for damping only closing movement of the sliding valve member 84.

The damping chamber housing section 52 has a cylindrical chamber bore 126 defined therein, and has a reduced diameter bore 128 extending through an upper first end 130 of chamber housing section 52 and communicated with the chamber bore 126. Damping chamber housing section 52 includes a second end 132 threaded at 134 for threaded connection to chamber end cap housing section 54.

The chamber end cap housing section 56 includes an end cap bore 136 disposed therethrough which is communicated with the chamber bore 126 of damping chamber housing section 52.

A piston means 138 is slidably received in the chamber bore 126 and divides the chamber bore 126 into a lower first chamber portion 140 and an upper second chamber portion 142.

The first and second chamber portions 140 and 142 comprise a sealed damping chamber 140, 142 which is filled with a hydraulic fluid, typically oil.

Piston means 138 includes first and second communication passages 144 and 146 extending therethrough and communicating the first and second chamber portions 140 and 142.

The damping means 122, is a fluid restrictor, such as that marketed as a Lee ViscoJet TM, and is disposed in the first communication passage 144 for restricting flow of hydraulic fluid from the first chamber portion 140 through the first communication passage 144 to the second chamber portion 142.

The bypass means 124 is a one-way check valve means which is disposed in the second communication passage 146 for preventing upward flow of hydraulic fluid from the first chamber portion 140 through the second communication passage 146 to the second chamber portion 142, and for freely permitting flow of hydraulic fluid from the second chamber portion 142 through the second communication passage 146 to the first chamber portion 140.

The check valve means 124 can be generally described as being arranged in hydraulic parallel with the fluid restrictor 122 for permitting relatively unimpeded flow of hydraulic fluid through the check valve means 124 when the sliding valve member 84 of flow valve means 80 moves to its said open position.

An annular piston seal 148 seals between the piston means 138 and the chamber bore 126.

A first piston extension 150 extends from the piston means 138 and is slidably and sealingly received within the reduced diameter bore 128 of damping chamber housing section 52. Two sliding O-ring seals 152 and 154 are provided between the first piston extension 150 and the reduced diameter bore 128. In the embodiment illustrated, the first piston extension 150 is integrally constructed with the piston means 138.

A second piston extension 156 extends downward from the piston means 138 and is slidably and sealingly received in the end cap bore 136 of chamber end cap housing section 54. A pair of sliding O-ring seals 158 and 160 are provided between second piston extension 156 and end cap bore 136. The second piston extension 156 is threadedly connected to an inner bore of piston means 138 at threaded connection 162.

The first and second piston extensions 150 and 156 have first and second free ends 164 and 166 defined thereon, respectively.

The sliding valve member 84, which includes a cup-shaped bearing member 168 on its upper end, freely abuts the second free end 166 of second piston extension 156. The bearing member 168 is used with existing valve members 84 which are necked down at their upper ends, in order to increase the bearing area engaging second free end 166.

The lowermost spring guide member 102 (see FIG. 1D) of spring biasing means 86 freely abuts the first free end 164 of first piston extension 150.

Thus, the piston means 138 and its piston extensions 150 and 156 are sandwiched between the push rod assembly 96 of spring biasing means 86 located thereabove, and the sliding valve member 84 of valve means 80 located therebelow. The biasing force of the springs 88, 90 and 92 of spring biasing means 86 pushing downward on the push rod assembly 96 keeps the push rod assembly 96 snugly engaged with the upper first free end 164, and keeps the lower second free end 166 snugly engaged with the upper end of sliding valve member 84, so that sliding valve member 84, piston means 138, and push rod assembly 96 move upward and downward together relative to housing 42 as the sliding valve member 84 moves upward to its open position and downward to its closed position.

The damping sub 120 has been designed to provide a hydraulic fluid filling means generally designated by the numeral 170 which is operably associated with the sealed chamber 140, 142 for filling the sealed chamber with hydraulic fluid without any substantial entrainment of air in the hydraulic fluid.

The hydraulic fluid filling means 170 includes an oil vent passage 172 disposed through the second piston extension 156 and communicated with the first chamber portion 140. Hydraulic fluid filling means 170 further includes a check valve means 174, disposed in the oil fill passage 172. The check valve means 174 will permit flow of fluid outward therethrough out of the first chamber portion 140, but will not permit flow of fluid inward therethrough to the first chamber portion 140. A plug means 176 is threadedly disposed in the lower end of oil vent passage 172.

The damping sub 120 is assembled and the sealed chamber 140, 142 is filled with oil without any substantial entrainment of air by the following procedure. This is done prior to assembly of the damping sub 120 with the remainder of the retrievable fluid control valve apparatus 10.

The damping chamber housing section 52 is held upside down, and the reduced diameter bore 128 thereof is temporarily blocked either with a hand, or some easily removable plug. A small amount of oil is poured into the chamber bore 126 and reduced diameter bore 128 of the upside down damping chamber housing section 52. Then, the piston assembly made up of piston means 138 and first and second piston extensions 150 and 156, which will also be turned upside down so that the first piston extension 150 extends downward, is lowered into the chamber bore 126 with the first piston extension 150 entering into the reduced diameter bore 128. As the piston assembly is pushed downward into the chamber bore 126 and reduced diameter bore 128 any air contained in the second chamber portion 142 will escape through the fluid restrictor 122 and/or check valve 124 until all of the air is evacuated and oil begins to pass upward out of second chamber portion 142 through the first communication passage 144 and the fluid restrictor 122 in place therein and/or through second communication passage 146 and check valve 124. Then, more oil is poured into the first chamber portion 140 on top of the upside down piston means 138. Next, the chamber end cap housing section 54 is turned upside down and threaded into engagement with the damping chamber housing section 52 at threaded connection 134. The second piston extension 156 will be slidingly received in the end cap bore 136. Initially, the plug means 176 is not in place within the oil vent passage 172. As the chamber end cap housing section 54 is screwed downward into engagement with the damping chamber housing section 52, air and excess oil contained in first chamber portion 140 will be forced out through the oil vent passage 172 and check valve 174. When the threaded connection 134 between chamber end cap housing section 54 and damping chamber housing section 52 is completely made up, the plug 176 will be installed in oil vent passage 172 to completely seal off the sealed chamber 140, 142.

As is apparent from the drawings, and a comparison thereof to the disclosure of Hyde U.S. Pat. No. 4,586,569, the damping sub 120 can be retrofit into the retrievable fluid control valve of the Hyde '569 patent so as to modify existing such control valves to add the damping feature of the damping sub 120.

Selection Of Fluid Restrictor 122 For Appropriate Hydraulic Damping

It is believed that the breakage of valve member 84 and valve seat 82 which has been experienced in field operations of prior art retrievable fluid control valve apparatus like that of Hyde U.S. Pat. No. 4,586,569 is probably caused by resonant vibration of the spring mass system made up of the spring and the sliding valve member when certain flow rates of fluid are pumped through the fluid control valve. Additionally, such damage may be caused by the sliding valve member slamming against the valve seat when the valve is moved to its closed position, even if no resonant vibration is present.

These problems can be substantially minimized if not completely eliminated by the proper selection of the fluid restrictor 122.

If the fluid restrictor 122 is appropriately chosen such that the spring mass system is overdamped, there is no possibility of resonant vibration in the system. This means that there is no flow rate of fluid down through the tubing string 22 and through the valve apparatus 10 which will cause the sliding valve member 84 to chatter at its fundamental resonant frequency. Also, if the system is extremely overdamped, the sliding valve member 84 will respond slowly enough to allow it to close softly on the seat 82.

A determination as to what amount of damping is required to ensure the desired valve performance without overdamping the system so severely that excessive closing times are produced had to be made. A mathematical model of the system was developed to aid in this determination. The undamped system is basically a simple single degree of freedom spring-mass system if all components are assumed to remain in contact with one another during operation. The nondamped system was first analyzed to determined the natural frequencies of the valve for one, two and three spring operation. The differential equation which describes this simple system was taken from Thomson, "THEORY OF VIBRATION WITH APPLICATIONS", 1981, and is:

$$MX+KX=0 \qquad \text{(Equation 1)}$$

Where: M=moving mass of system
K=combined spring rate of system

The natural frequency in radians/sec of this system is given by:

$$w_n=\sqrt{K/M} \qquad \text{(Equation 2)}$$

The natural frequency in Hertz of this system is given by:

$$f_n=(1/(2\cdot PI))\cdot\sqrt{K/M} \qquad \text{(Equation 3)}$$

The first step in calculating the natural frequencies was to calculate the individual component weights. These calculated weights in one preferred embodiment of the invention are:

| COMPONENT | EFFECTIVE WEIGHT (Lbf) | SYMBOL |
|---|---|---|
| SPRING (88, 90 or 92) | 0.32727 | $W_k$ |
| PUSH ROD (104 or 106) | 0.47540 | $W_{pr}$ |
| GUIDE (98, 100 or 102) | 0.34502 | $W_g$ |
| SPACER (94) | 0.03356 | $W_{sp}$ |
| PISTON } (84) | 1.03750 | $W_{pi}$ |
| VALVE } (84) | 0.53543 | $W_v$ |

Using these values for the weights of the various components the system masses for the one, two and three spring undamped systems are:

$$M_1 = (W_k + 2(W_{sp}) + W_g + W_v)/g$$
$$M_2 = (2(W_k) + 4(W_{sp}) + 2(W_g) + W_{pr} + W_v)/g$$
$$M_3 = (3(W_k) + 6(W_{sp}) + 3(W_g) + 2(W_{pr}) + W_v)/g$$

Substituting in the appropriate values for the component weights and using a value of 386.1 In/sec$^2$ for g masses are:

$$M_1 = 0.003302\ (\text{Lbf-sec}^2)/\text{In}$$
$$M_2 = 0.006448\ (\text{Lbf-sec}^2)/\text{In}$$
$$M_3 = 0.009595\ (\text{Lbf-sec}^2)/\text{In}$$

Using Equation 2 and the proper multiple of the spring constant K of 835 Lbf/In the natural frequencies for the undamped system are:

| |
|---|
| $w_{n1}$ = 502.869 rad/sec = 80.034 Hz |
| $w_{n2}$ = 508.916 rad/sec = 80.996 Hz |
| $w_{n3}$ = 510.953 rad/sec = 81.321 Hz |

As can be seen these frequencies are fairly low and very close to the same value.

In order to determine the amount of damping needed to make the valve system an overdamped system the natural frequencies of the system containing the additional mass of the damping piston assembly (138, 150 and 156) also had to be calculated. The mass of the damped system is simply the mass of the damping piston assembly added to the mass of the undamped system. Upon performing these additions the new system masses become:

| |
|---|
| $M_{d1}$ = 0.005989 (Lbf-sec$^2$)/In |
| $M_{d2}$ = 0.009135 (Lbf-sec$^2$)/In |
| $M_{d3}$ = 0.012282 (Lbf-sec$^2$)/In |

Again using Equation 2 and a spring rate value of 835 Lbf/In the natural frequencies of the damped system are:

| |
|---|
| $w_{nd1}$ = 373.400 rad/sec = 59.428 Hz |
| $w_{nd2}$ = 427.567 rad/sec = 68.049 Hz |
| $w_{nd3}$ = 451.616 rad/sec = 71.877 Hz |

These frequencies are considerably lower than the frequencies calculated for the undamped system. This should be expected as the mass has been increased in the damped system.

A final equation must be used to determine the critical amount of damping needed to overdampen the system. This equation is:

$$C_c = 2Mw_{nd} \quad \text{(Equation 4)}$$

Where: $C_c$=The critical amount of damping required.

Using this equation and the already calculated natural frequencies the resulting values of critical damping required are:

| |
|---|
| $C_{c1}$ = 4.4726 (Lbf-sec)/In |
| $C_{c2}$ = 7.8117 (Lbf-sec)/In |
| $C_{c3}$ = 11.094 (Lbf-sec)/In |

The above values of critical damping provide a guideline as to how much damping is required to overdamp the spring-mass system of the retrievable fluid control valve 10. After obtaining this information the next step was to relate this information to the actual hydraulic restrictor 122 to be used in the valve damping system.

The equations which describe the behavior of a fluid flowing through a hydraulic restrictor have been developed by the Lee Company of Westbrook, Conn., for use with a system of units which define the measure of hydraulic resistance in Lohms. These equations and their development are available in "TECHNICAL HYDRAULIC NOTEBOOK" published in 1984 by The Lee Company Technical Center of Westbrook, Conn. The equation taken from this reference for use in the development of the hydraulic damper is:

$$I = 77(V/L)\sqrt{H/S} \quad \text{(Equation 5)}$$

Where: I=The flow rate in In$^3$/sec through the restrictor.

V=Viscosity compensation factor.

L=The Lohm rating for the restrictor.

H=The differential pressure across the restrictor.

S=The specific gravity of the fluid.

For this work values for V and S have been chosen for SAE 30 motor oil at 200 degrees F. and a differential pressure across the metering piston of 1000+PSI. Based upon these assumptions the values for V and S are 1.0 and 0.81, respectively. Substituting these values into Equation 5 the fluid flow equation becomes:

$$I = 85.55/L\sqrt{H} \quad \text{(Equation 6)}$$

The largest piston area which could be used was designed into the damper. The reason for this was to create a situation where there is a high flow rate across the piston so a larger ID restrictor could be used. This is an advantage because the largest possible ID restrictor is the least likely to plug off when passing debris in the metering fluid. Physical considerations limited the piston area to 0.70 In$^2$. To determine the velocity of the damping piston the fluid flow rate can be divided by the piston area to get:

$$X = I/A = 122.22(1/L)\sqrt{H} \text{ In/sec} \quad \text{(Equation 7)}$$

To find the minimum Lohm rating needed to overdamp the system the worst case must be considered. This is when three springs are used with six spacers. When the valve member 84 is fully open it has moved 0.25 inch in the example under consideration. This gives open and closed spring forces F1 and F2 of 4490 and 3592 pounds, respectively. Assuming a constant average force to get a rough idea of the correct Lohm rating to give the proper damping, the average differential pressure H becomes:

$$H_{avg} = (F1 + F2)/(2A) = 5773\ PSI \quad \text{(Equation 8)}$$

Substituting this average differential pressure into Equation 7 gives the relation:

$$X_{avg} = 9286.2/L_{avg} \text{ In/sec} \quad \text{(Equation 9)}$$

The average force on the piston is given by:

$$F_{avg} = (F1 + F2)/2 = 4041\ Lbf \quad \text{(Equation 10)}$$

Average damping is defined as:

$$C_{avg} = F_{avg}/X_{avg} \quad \text{(Equation 11)}$$

Combining Equations 9 and 11 results in a relation for average hydraulic resistance which is:

$$L_{avg} = C_{avg}(9286.2/F_{avg}) \quad \text{(Equation 12)}$$

Substituting in the previously calculated critical damping for the three spring system yields:

$$L_{3avg} = C_{c3}(9286.2/F_{avg}) = 11.094(9286.2/4041) = 25.494 \text{ Lohms}$$

This rough estimate of the required Lohm rating establishes a minimum value for the amount of hydraulic resistance which must be used to overdampen the retrievable fluid control valve system 10. The amount of resistance actually used should be much higher than this value to ensure full damping and to create a metering shut effect when the valve closes.

A rather slow closing speed was chosen for the valve member 84 because it is highly likely that the valve will often be partially open during operation and not fully open. If the full stroke closing time was fairly short, the valve might be able to open and close quickly when the operating stroke is very small. This might cause a shortened ball (valve member) and seat life by causing excessive pinching of the high pressure fluid stream passing through the valve. A target full stroke closing time of approximately 0.5 seconds was chosen for the median valve spring configuration of two springs and no spacers. It was hoped that this would give only slightly longer closing times for the weaker spring configurations and shorter closing times for the stronger spring configurations.

It is desirable that the closing time not be too long, e.g., substantially greater than one second. Too long of a closing time would create an unacceptably slow response time for valve apparatus 10, and could for example allow excessive loss of expensive chemicals from tubing string 22.

Another mathematical model for the metering effect of the damping piston had to be developed to predict the closing speed of the valve when released from the full open position. The differential equation which governs this system is the following:

$$AX=I \qquad \text{(Equation 13)}$$

Remembering that:

$$I=(85.55/L)\sqrt{H} \qquad \text{(Equation 6)}$$

Equation 13 becomes:

$$AX=(85.55/L)\sqrt{H} \qquad \text{(Equation 14)}$$

The differential pressure is dependent on the position of the piston because of the changing force as the spring(s) relax. Using the force at the full open and full closed positions an expression for the differential pressure as a function of the piston position can be developed in the following way:

$$H=F_{sp}/A \qquad \text{(Equation 15)}$$

Where: $F_{sp}$=The force generated by the spring.
and: $F_1=F_{sp}$@Full open position.
$F_2=F_{sp}$@Full closed position.
Delta x=0.25 - The stroke length of the valve.

So a linear relationship for the spring force as a function of x can be described as:

$$F_{sp}(X)=F_1-F_2X \qquad \text{(Equation 16)}$$

This relationship leads to the linear relationship for the differential pressure:

$$H(X)=(F_1-F_2X)/A \qquad \text{(Equation 17)}$$

Substituting this expression into Equation 14 yields:

$$AX=(85.55/L)\sqrt{(F_1-F_2X)/A} \qquad \text{(Equation 18)}$$

This is a nonlinear first order differential equation. An analytical solution to this equation is difficult to obtain so this equation was solved numerically using Euler's method on a microcomputer. The state-variable equations after substituting in the appropriate value for A which describes Equation 18 are:

$$X=146.1(1/L)\sqrt{F_1-F_2X} \qquad \text{(Equation 19)}$$

$$X=X_o+Xh \qquad \text{(Equation 20)}$$

Where: $X_o$=The initial piston position.
h=The time step size.
and $X_o$=0@T=0

Figure 3:
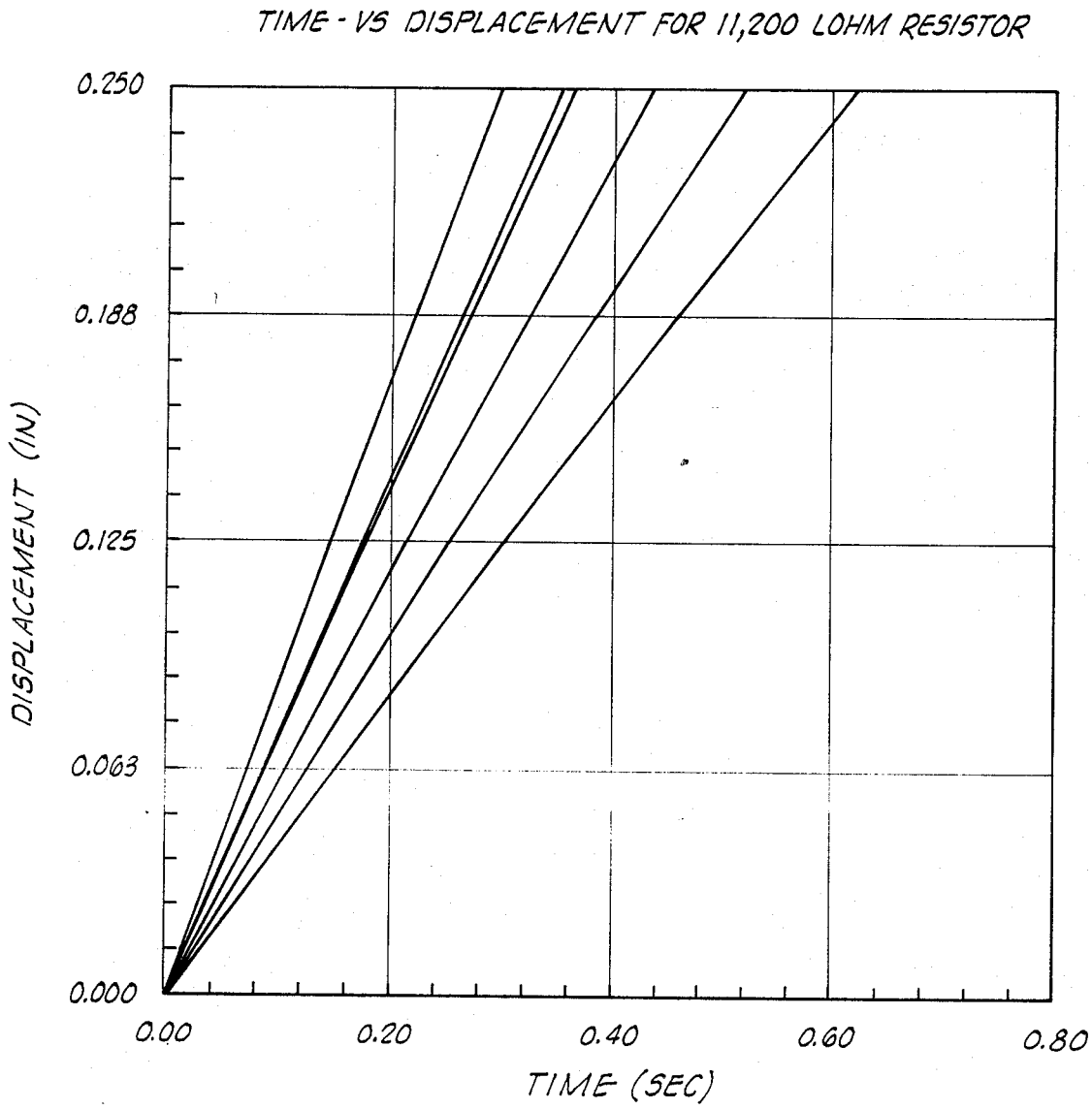
FIG. 3 is a graphic illustration of closing time versus displacement for a preferred embodiment of the retrievable fluid control valve.

The basic scheme was to select the coefficients of $F_1$ and $F_2$ for one of the spring combinations, then solve Equation 18 using different Lohm values each time. The solution is given in terms of piston position versus time. This information can be examined to determine which of the different Lohm ratings produces the full stroke displacement (0.25 In) in the desired time. After solving Equation 18 using the spring coefficients for three springs and six spacers using the different Lohm ratings of available Lee restrictors a Lohm rating of 11,200 Lohms was selected for the restrictor 122. Time versus displacement plots for the maximum and minimum spring force settings for one, two and three springs and a 11,200 Lohm resistor are shown in FIG. 3. Although the plots of FIG. 3 appear to be linear they are not. The differential pressure change over the operating range of the valve is small enough that the response in this range is fairly linear. The closing speeds are fairly slow, but not slow enough to cause excessive fluid loss when pump pressure is removed.

The damping means or restricted orifice 122 chosen by the above techniques, can be generally characterized as a means for providing a closing time in a range of from about 0.25 seconds to about 1.0 second for the sliding valve member 84 to move from its open position to its closed position for all spring rates in the spring rate range provided by the adjustable spring biasing means 86. The damping means 122 can also be described as a means for providing a closing time of at least about 0.25 seconds for the sliding valve member 84 to move from its fully open position to its fully closed position for all spring rates in the said spring rate range.

By appropriate choice of the fluid restrictor 122 as just described, the valve apparatus 10 will have an increased operating success due to the lack of valve and seat failures related to hydrodynamic fluttering and hammering. The valve apparatus 10 will also have reduced maintenance costs due to increased valve and seat life, and will experience smoother, quieter operation.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of the elements thereof may be made by those skilled in the art which changes are encompassed within the scope and spirit of the present invention as defined by the appended claims.

What is claimed is:

1. A fluid control valve apparatus for controlling fluid flow through a tubing string of a well, comprising:

a housing including:

sealing means for sealingly engaging said tubing string;

a flow passage defined through said housing and having an open end defined in said housing below said sealing means; and a flow port defined through said housing and communicating said flow passage with an exterior of said housing above said sealing means;

a flow valve means, disposed in said housing, and movable between a closed position wherein said flow passage is closed, and an open position wherein said flow passage is open;

spring biasing means, associated with said flow valve means, for biasing said flow valve means toward its said closed position;

differential area piston means, associated with said flow valve means, for overcoming said spring biasing means and for moving said flow valve means to its said open position when a fluid pressure exterior of said housing at said flow port exceeds a predetermined value; and damping means, associated with said flow valve means, for substantially overdamping closing movement of said flow valve means from its said open position to its said closed position, and for eliminating the possibility of resonant vibration of said flow valve means regardless of a rate of fluid flow through said flow passage.

2. The apparatus of claim 1, wherein:

said damping means is further characterized as a means for extremely overdamping said closing movement of said flow valve means.

3. The apparatus of claim 1, wherein:

said spring means is adjustable within a range of spring rates; and said damping means is further characterized as a means for extremely overdamping said closing movement of said flow valve means for all spring rates within said range.

4. The apparatus of claim 1, wherein:

said damping means is further characterized as a means for damping only said closing movement of said flow valve means; and said apparatus further includes bypass means for permitting undamped opening movement of said flow valve means from its said closed position to its said open position.

5. The apparatus of claim 1, wherein:

said damping means is a hydraulic damping means including a fluid restrictor through which hydraulic fluid must pass to permit said flow valve means to move to its said closed position.

6. The apparatus of claim 5, wherein:

said apparatus further includes a check valve means, arranged in hydraulic parallel with said fluid restrictor, for permitting relatively unimpeded flow of said hydraulic fluid therethrough when said flow valve means moves to its said open position.

7. The apparatus of claim 5, wherein:

said spring means is adjustable within a spring rate range; and said damping means is further characterized as a means for substantially overdamping said closing movement of said flow valve means for all spring rates in said range.

8. The apparatus of claim 7, wherein:

said damping means is further characterized as a means for providing a closing time in a range of from about 0.25 second to about 1.0 second for said flow valve means to move from its said open position to its said closed position for any spring rate in said spring rate range.

9. The apparatus of claim 7, wherein:

said damping means is further characterized as a means for providing a closing time of at least about 0.25 second for said flow valve means to move from its said open position to its said closed position for any spring rate in said spring rate range.

10. The apparatus of claim 5, wherein:

said housing has a sealed chamber defined therein which contains said hydraulic fluid; and said apparatus further comprises hydraulic fluid filling means, operably associated with said sealed chamber, for permitting said sealed chamber to be filled with said hydraulic fluid without any substantial entrainment of air in said hydraulic fluid.

11. A damping sub for a fluid control valve, comprising:

a damping chamber housing section having a cylindrical chamber bore defined therein, having a reduced diameter bore extending through a first end of said chamber housing section and communicated with said chamber bore, and having a second end;

a chamber end cap housing section connected to said second end of said chamber housing section, and having an end cap bore disposed therethrough and communicated with said chamber bore;

piston means slidably received in said chamber bore and dividing said chamber bore into a first chamber portion and a second chamber portion, said piston means including first and second communication passages extending therethrough and communicating said first and second chamber portions;

fluid restrictor means, disposed in said first communication passage, for restricting flow of hydraulic fluid from said first chamber portion through said first communication passage to said second chamber portion; and check valve means, disposed in said second communication passage, for preventing flow of hydraulic fluid from said first chamber portion through said second communication passage to said second chamber portion, and for freely permitting flow of hydraulic fluid from said second chamber portion through said second communication passage to said first chamber portion;

a first piston extension, extending from said piston means, and slidably and sealingly received in said reduced diameter bore of said chamber housing section; and a second piston extension, extending from said piston means and slidably and sealingly received in said end cap bore of said chamber end cap housing section.

12. The damping sub of claim 11, further comprising:

an oil vent passage disposed through one of said first and second piston extensions and communicated with one of said first and second chamber portions;

second check valve means, disposed in said oil vent passage, for permitting air and oil to escape from said one of said first and second chamber portions as said damping chamber housing section and said chamber end cap housing section are connected together; and a plug means for closing said oil vent passage after said housing sections are connected together.

13. The damping sub of claim 12, wherein:

said damping chamber housing section and said chamber end cap housing section are threadedly connected together.

14. The damping sub of claim 11, in combination with said fluid control valve, wherein:

said first and second piston extensions have first and second free ends defined thereon, respectively; and said fluid control valve includes:

a sliding valve member freely abutting one of said first and second free ends; and a spring biasing means freely abutting the other of said first and second free ends.

15. The damping sub and control valve combination of claim 14, wherein:

said first chamber portion is located on a side of said piston means nearest said sliding valve member.

* * * * *